US005106456A

United States Patent [19]

Voitto et al.

[11] Patent Number: 5,106,456

[45] Date of Patent: Apr. 21, 1992

[54] METHOD AND APPARATUS FOR FACILITATING THE DISCHARGE OF PULP

[75] Inventors: Reponen Voitto, Karhula; Timperi Jukka; Vesala Reijo, both of Kotka; Vikman Vesa, Kymi, all of Finland

[73] Assignee: A. Ahlstrom Corporation, Noormarkku, Finland

[21] Appl. No.: 292,489

[22] Filed: Dec. 30, 1988

[30] Foreign Application Priority Data

Jan. 5, 1988 [FI] Finland ..... 880018

[51] Int. Cl.[5] ..... D21D 5/00

[52] U.S. Cl. ..... 162/17; 162/52; 162/57; 366/307; 366/313; 366/327; 366/329

[58] Field of Search ..... 162/17, 100, 216, 246, 162/243, 18, 52, 57, 56, 261; 366/307, 309, 312, 313, 327, 329; 415/413; 241/46.17, 46.11, 28; 55/408

[56] References Cited

U.S. PATENT DOCUMENTS

| | | | |
|---|---|---|---|
| 2,803,540 | 8/1957 | Durant et al. | 162/246 X |
| 3,096,234 | 7/1963 | Armstrong et al. | 162/246 X |
| 3,323,465 | 6/1967 | Stillebroer . | |
| 3,597,904 | 8/1971 | Jakobsson et al. . | |
| 3,964,962 | 6/1976 | Carlsmith | 162/246 X |
| 3,999,965 | 12/1976 | Burgess . | |
| 4,093,506 | 6/1978 | Richter . | |
| 4,253,857 | 3/1981 | Fisher . | |
| 4,326,863 | 4/1982 | Day et al. . | |
| 4,362,536 | 12/1982 | Gullichsen . | |
| 4,410,337 | 10/1983 | Gullichsen et al. . | |
| 4,435,122 | 3/1984 | Niskanen et al. . | |
| 4,435,193 | 3/1984 | Gullichsen et al. . | |
| 4,535,943 | 8/1985 | Couture . | |
| 4,538,765 | 9/1985 | Mayr et al. . | |
| 4,568,196 | 2/1986 | Hacheney | 241/46.17 X |
| 4,596,631 | 6/1986 | Prough et al. . | |
| 4,619,736 | 10/1986 | Henricson et al. . | |
| 4,725,007 | 2/1988 | Chupka . | |
| 4,744,722 | 5/1988 | Sämpi et al. . | |
| 4,780,053 | 10/1988 | Gullichsen | 415/143 |

FOREIGN PATENT DOCUMENTS

| | | | |
|---|---|---|---|
| 1121637 | 4/1982 | Canada . | |
| 0157279 | 10/1985 | European Pat. Off. . | |
| 0269124 | 6/1988 | European Pat. Off. . | |
| 3111225 | 1/1982 | Fed. Rep. of Germany . | |
| 3219740 | 12/1982 | Fed. Rep. of Germany . | |
| 3429515 | 2/1986 | Fed. Rep. of Germany . | |
| 384173 | 10/1987 | Fed. Rep. of Germany . | |
| 3590322 | 5/1988 | Fed. Rep. of Germany . | |
| 3153358 | 11/1988 | Fed. Rep. of Germany . | |
| 17162 | 8/1936 | Finland . | |
| 1209603 | 3/1960 | France | 162/246 |
| 668666 | 3/1952 | United Kingdom . | |

OTHER PUBLICATIONS

Medium-Consistency Technology, TAPPI (Sep. 1981), vol. 64, No. 9, pp. 113-116.

Pulp & Paper Canada 85:6 (1984), pp. 13-17.

Mittelkonsistenz-Technologie-MC Pumpen und MC--Mischer, lecture of eng. Maurer of KAMYR AG in Bled Nov. 24, 1983.

Ahlstrom MC-PUMPS 1987.

Paper for Presentation at the 1984 TAPPI Pulping Conference, pp. 109-114.

*Primary Examiner*—David A. Simmons
*Assistant Examiner*—Thi Dang
*Attorney, Agent, or Firm*—Cohen, Pontani, Lieberman & Pavane

[57] ABSTRACT

A method of facilitating the discharge of high consistency pulp from a pulp containing space such as a mass towe or the like and for treating pulp therein, includes a rotor (10) arranged in a high consistency pulp containing space (2) for breaking up pulp planks (7) and for homogenizing the pulp thereby facilitating the flow thereof toward the impeller of a pump (5).

25 Claims, 3 Drawing Sheets

METHOD AND APPARATUS FOR FACILITATING THE DISCHARGE OF PULP

FIELD OF THE INVENTION

The present invention relates to a method and apparatus for facilitating the discharge of high consistency pulp from a storage chamber such as a drop leg, a high consistency pulp tower or the like space containing high consistency pulp and for treating the pulp in space. The method and apparatus according to the invention are especially suitable for the pulp and paper industry.

BACKGROUND OF THE INVENTION

The cellulose industry utilizes many different processes and apparatus, such as for thickening, in which the pulp is discharged at a high consistency of from about 8 to about 25%. It is normal practice to direct the pulp either to a mass tower, to a drop leg or a suction chamber, the latter two being of smaller size, and wherefrom the pulp is transferred by pumping for further processing. Displacement type high consistency pumps are traditionally used for this kind of pumping.

Recently, the tendency has been to replace displacement pumps by specially constructed centrifugal pumps, which provide several advantages compared to displacement pumps, e.g. centrifugal pumps are of smaller size, have greater flexibility of capacity, and have little need for service.

Usually, the above mentioned types of pumps also operate rather well with pulp having considerably high consistencies, provided the flow of pulp through the suction chamber or drop leg is even and the pulp is homogeneous in quality. In practice, this is, however, not the case when the pulp flows to the suction side of the pump, for example, from disk or drum thickeners or washers. Generally, the pulp received from such apparatus contains fairly large plank-like lumps. This kind of non-homogeneous and lumpy pulp will easily adhere to and/or clog the drop leg by forming arch-like formations in front of the suction opening of the pump thus preventing the pulp, having already a rather low consistency, from flowing into the pump inlet. Normally, pumping at such consistencies and with the above-mentioned pumps is thus rendered very difficult and often impossible. Additionally, this kind of pulp includes great amounts of air which is harmful to the pumping operation and the further processing thereof.

Efforts have been made to solve the above-mentioned problems by using different types of screw conveyors which are arranged to feed the pulp from the bottom of the suction chamber to the suction opening of the pump. Also, with this kind of feed apparatus movement of the non-homogenous pulp is often impeded above the feed apparatus so that the pulp at high consistency, accumulates in arch-like formations. Attempts have been made to solve this problem with displacement pumps by sufficiently overdimensioning the pump so that the screw conveyor operating as a feed apparatus of the pump is practically empty during the operation thereof, whereby the pulp is intended to drop directly onto the screw conveyor and thus prevent arching or immobilization of the pulp in the drop leg. This effort results, in addition to the large size and high price of the pump, in the entry of air into the pulp to be pumped; the air being of course harmful to the process. Additionally, there is always the risk of the drop leg becoming only partially filled and the pulp getting stuck, if, for example, the pulp flowing from the drum thickener loosens unevenly and drops in large planks.

Furthermore, a screw is known which is used in mass towers and drop legs and which is provided with a thread parallel to the shaft of the tower, mostly the vertical shaft, and which is open from the inside and by which the pulp pillar or column is transferred downwardly. With such arrangement, if used together with a bottom wiper in the tower, it is at best possible to prevent the arching of the pulp in front of the suction opening of the pump, but this method frequently results in lumping of the pulp. Additionally, this large screw requires additional power which stands in no relation to the benefits achieved.

SUMMARY OF THE INVENTION

In order to eliminate or at least minimize the disadvantages of the above-mentioned known methods and apparatus, a new method and apparatus have been developed for the discharge of high consistency fibrous material such as high consistency paper pulp from a pulp containing space such as a drop leg and the like, wherein the pulp in the space is homogenized and densified, and wherein the downward flow of the pulp is facilitated and the pulp is pumped from the space substantially at its original consistency. If desired, it is also possible to fluidize the pulp with a so-called fluidizing pump or MC pump so as to further assist the flow of the pulp to the pump.

An embodiment of the apparatus in accordance with the present invention comprises at least one member arranged in the space containing high consistency pulp, said member acting to break up pulp particles or the like, to homogenize the high consistency pulp and to facilitate the flow of the pulp toward the pumping apparatus.

Another embodiment of the apparatus according to the present invention is characterized in that the pump breaking up the pulp particles is connected at the discharge side thereof with at least one pulp passage or conduit leading back to the pulp space, whereby a portion of the pulp, which is homogenized and pressurized during the pumping step, is fed back to the pulp space to add to homogenization thereof and to densify the pulp in said space.

The method and apparatus in accordance with the present invention allow chambers—such as mass towers, drop legs, and suction chambers—containing pulp having a consistency of from about 8 to about 25% to be discharged at this high consistency so that the transfer of pulp from the chamber forward can be carried out by pumps in accordance with known techniques. Additionally, the method and apparatus of the present invention may also be utilized for treating the pulp in such pulp containing chambers with chemicals, vapor or the like and also for discharging or withdrawing of gas from high consistency pulp.

BRIEF DESCRIPTION OF THE DRAWINGS

The method and apparatus in accordance with the present invention are now described in more detail, by way of example, with reference to the accompanying drawings, in which.

DESCRIPTION OF THE PRESENTLY PREFERRED EMBODIMENTS

Figure 1:
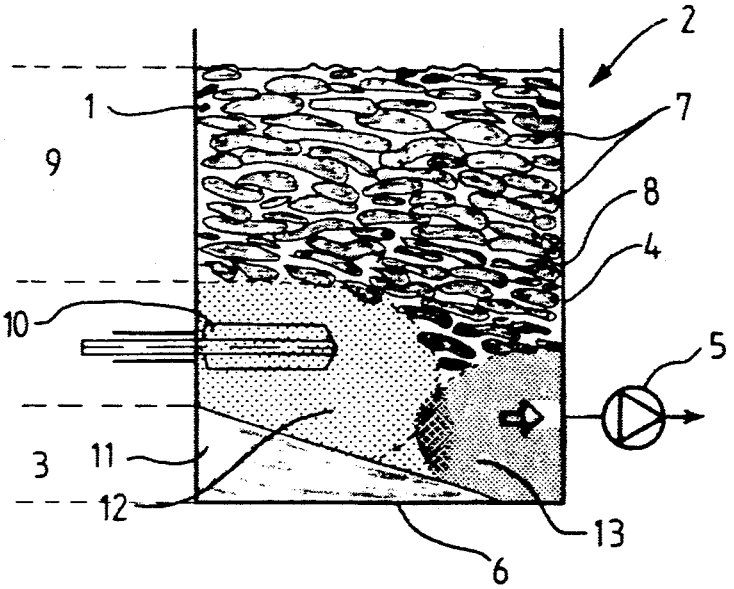
FIG. 1 is a schematic illustration of the operation of the method of the present invention and of one embodiment thereof exemplified by a conventional drop leg or similar chamber.

As shown in FIG. 1, the present invention includes a pulp containing space such as a mass tower, a drop leg, a suction chamber or the like chamber or tower 2 containing high consistency pulp 1 having a consistency of from about 8 to about 25%. Connected to the pulp containing chamber 2 through the wall 4 thereof, is pump 5. Pump 5 is preferably connected to the bottom part 3 of chamber 2 and is a pump suitable for the pumping of high consistency pulp such as a centrifugal pump or a displacement pump. Alternatively, pump 5 may also be connected to bottom 6 of chamber 2.

As illustrated in FIG. 1, pulp 1 in chamber or tower 2 contains large particles 7 mostly pulp planks transferred to the chamber from thickeners and other pulp treatment apparatus. The pulp particles form a non-homogeneous zone 9 containing air cavities 8 in the upper part of the tower. It should be understood that the terms mass tower, drop leg or suction chamber are used herein alternatively and all designate a high consistency pulp containing space. It is generally impossible to pump this kind of high consistency pulp without substantially diluting the pulp prior to pumping or treatment thereof. Accordingly, a rotor 10 is mounted in wall 4 of chamber 2 adjacent to centrifugal pump 5 in the vicinity of the inlet side of the pump. Through its rotation, rotor 10 is breaking up the pulp into a more homogeneous mass and maintaining the pulp in dynamic motion so that the effective range of rotor 10 extends into and overlaps the effective range 13 of the impeller of pump 5 or the effective range of the fluidizing rotor of a medium or high consistency pump which acts as an extension of the pump impeller. Thus, the area of dynamic motion created by the rotating rotor 10 actually assists the withdrawing of the pulp by a pump by creating a uniform flow of homogeneous pulp in the direction of the suction opening of pump 5. At the same time the zone 11 composed of pulp sitting on the bottom part 3 of chamber 2 is reduced, and no arching of pulp or pulp adhering in front of the suction opening of the pump will take place. The effective range 12 of rotor 10 and effective range 13 of pump 5 do not have to actually overlap but interaction between the two is required so that the flow of pulp toward the suction opening of the pump is enhanced and assisted thereby.

As will be further discussed below, by using a suitable design and dimensioning of rotor 10 as well as choosing a suitable rotational speed thereof, gas is separated from the pulp due to centrifugal force and collected at a center part of rotor 10, wherefrom the gas may, by appropriate and known arrangements, be carried away. Rotor 10 may also be efficiently used to effect a mixing of chemicals, water or vapor added to the pulp. Generally, the actual manner or position of mounting rotor 10 is not of great importance, as long as a sufficiently large range 12 of effect is created by rotation of the rotor, which effect extends to or at least interacts with the effective range of the pump thereby facilitating and indeed assisting the pumping of the pulp from the container. Accordingly, and depending on the size and design of chamber 2, there may be more than one rotor 10 located on the suction side of pump 5 to form as perfect an effective range 12 as possible. The positioning of one or more rotors 10 also depends on whether the rotor is used for separating and discharging gases and/or, for example, for mixing of chemicals.

By appropriately positioning and the proper design of the rotor 10, a pumping effect may also be produced acting to move the pulp toward the suction opening of pump 5. It is also possible with the rotors to create an effect, the so-called deflaking, i.e. a breaking up of fiber flocs which means a breaking up process which is more efficient than the breaking up of a pulp planks.

By appropriately dimensioning the apparatus it is also possible to produce a high consistency pulper. The upper part of the chamber is so dimensioned that the paper pulp entering it has time to become sufficiently damp and get mixed before the paper pulp comes to the first rotor, where the dispersion takes place. Thereafter, it is possible either to arrange a second damping zone, a second dispersion rotor or both before the pulp reaches the range of the pump itself and its rotor.

Figure 2:
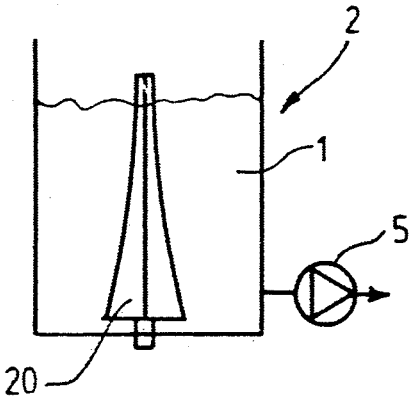
FIG. 2 is a schematic illustration of a second embodiment of the present invention.

FIG. 2 illustrates a rotor 20 protruding upward from the bottom 6 of mass chamber 2 and extending throughout the entire pulp layer 1. Characteristic of this embodiment is an especially good ability to separate gas, because the separated gases are able to exit from the center or center region of rotor 20 directly to the atmosphere in the chamber. Additionally, rotor 20 may be so designed and located that it causes the pulp to transfer or be moved toward pump 5. Of course, rotor 20 may alternatively be mounted so that it extends from the top downward into the chamber, whereby it is not necessary to arrange the mounting with bearings at the bottom of the mass chamber nor is it necessary to provide an opening therein.

Figure 3:
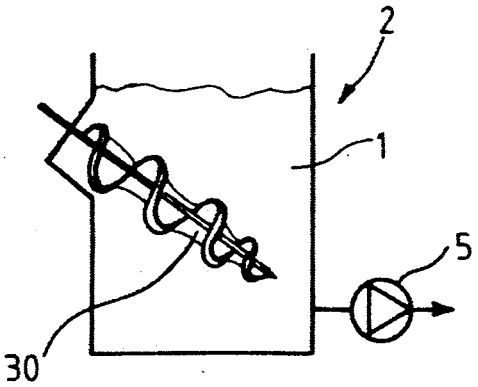
FIG. 3 is a schematic illustration of a third embodiment of the present invention.

FIG. 3 illustrates a rotor 30 mounted in an inclined position on wall 4 of chamber 2. The rotor is screw-shaped in such a way that it imparts to the pulp a component of motion which is directed toward pump 5. In an alternative embodiment of FIG. 3, the bottom of the space containing pulp is inclined, for example, parallel to the shaft of rotor 30, whereby it is possible to avoid the formation of an unnecessary layer of standing pulp at the bottom of the chamber or pulp space 2. If such an inclined bottom of the pulp space is even or flat, many different rotor alternatives may be utilized. For example, a rotor which is axially relatively short, but radially more extensive and rotatable at a level parallel to the bottom may be utilized, as well as any of the rotor types shown in FIGS. 1–7. Further, an additional advantage is that the bottom of the pulp space 2 may be formed tapered or chute-shaped so that the rotor, which is screw-like as in FIG. 3 or provided with straight foils or plates as in FIG. 1, is located rather close to the bottom of the chute, whereby the rotor fluidizes the pulp entering the bottom of the space, which pulp therefore flows easily along the chute toward the suction opening of the pump.

Figure 4:
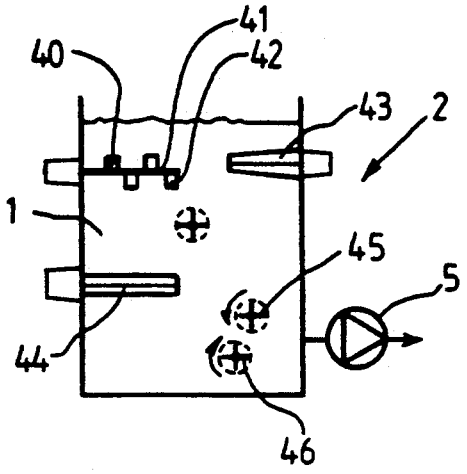
FIG. 4 is a schematic illustration of a fourth embodiment of the present invention.

FIG. 4 discloses an apparatus in which several different rotor alternatives are mounted to mass tower 2. In addition to illustrating different rotor variations, the drawing also shows the location of several rotors in chamber 2. The rotors may be either different or similar in shape. The purpose of the rotors may vary somewhat as some of the rotors may be used to mix chemicals or vapor into the pulp whereas others may be used to discharge gases from the pulp in the chamber. The most relevant common feature among different rotors, however, is their homogenizing effect on the pulp thereby greatly facilitating the discharge of the pulp from the mass chamber.

A rotor 40 is shown in FIG. 4 which comprises a shaft 41 with pivot-like foils or plates 42 mounted on it. This kind of rotor is especially efficient when chemicals are mixed into the pulp. Other rotor alternatives are rotor 43 the blades of which become narrower toward the top of the blade and rotor 44 which is a version with straight blades extending substantially along the axis of rotation. Additionally, two rotors 45 and 46, which are relatively close to each other and are rotating in opposite directions with respect to each other, are arranged close to pump 5 for directing the pulp flow toward the pump inlet thereof.

Figure 5:
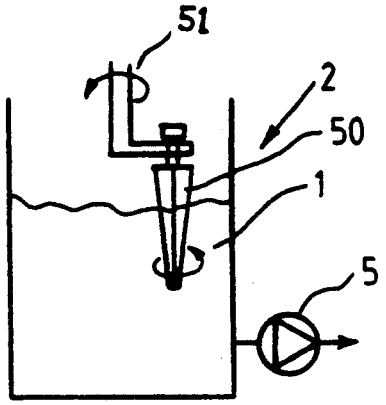
FIG. 5 is a schematic illustration of a fifth embodiment of the present invention.

FIG. 5 discloses an apparatus, in which, in addition to the main rotational movement of rotor 50 around the axis thereof, rotor 50 is also movably mounted for slower rotation in the direction of arrow 51, for example, similar to a planetary gear, for enlarging the effective range thereof, whereby it is possible to obviate the requirement for several rotors and thus gain savings in consumption of power.

Figure 6:
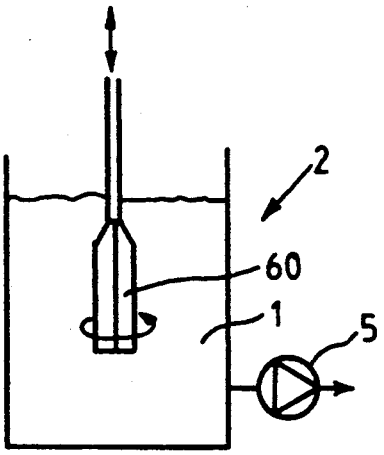
FIG. 6 is a schematic illustration of a sixth embodiment of the present invention.

FIG. 6 discloses an apparatus having a rotor 60 which has in addition to its main rotational movement, an auxiliary alternating axial movement, by which the region of influence or effective zone of the rotor is gradually moved along the entire height of the chamber 2.

Figure 7:
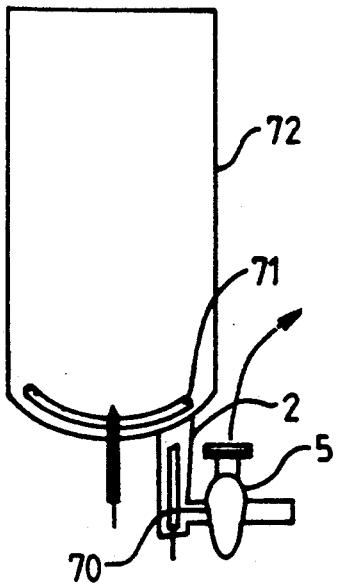
FIG. 7 is a schematic illustration of a seventh embodiment of the present invention.

FIG. 7 discloses another embodiment of the present invention, in which mass tower 72 and drop leg 2 are connected in such a way that the pulp in mass tower 72 is discharged by means of a bottom wiper 71 into drop leg 2 arranged below the bottom of mass tower 72. Pump 5 is mounted to the bottom part of the drop leg for further transfer of the pulp. When the consistency of the pulp is sufficiently high and while the discharge of pulp from mass tower 72 to drop leg 2 can be achieved by wiper 71, the diameter of drop leg 2 is usually so small that the movement of high consistency pulp through drop leg 2 toward pump 5 is impeded due to arching of the pulp so that pump 5 no longer receives any pulp for pumping. To eliminate or minimize this disadvantage, means 70 has been arranged in the drop leg 2 for facilitating the flow of the pulp to the bottom of the drop leg, i.e. to the pump. Means 70 may be either one single long rotor extending substantially along the entire height or length of drop leg 2 or a combination of several smaller rotors mounted on the wall of drop leg 2. This arrangement thus enables the discharge of pulp from mass tower 72, for example, by utilizing a fluidizing centrifugal pump in such a way that the pump is mounted horizontally directly at the bottom of drop leg 2 without the need to hang the pump in an upright position below the bottom part of mass tower 72.

The above described embodiments are given to illustrate different types of rotors and differently mounted rotors, the construction of which at its simplest form comprises at least one radial foil mounted on a shaft and preferably extending therefrom in substantial radial direction. In some cases (FIG. 2) the foils may be wider at one end of the rotor and in the radial direction thereof in order to create a radial pumping effect, in some cases (FIG. 3) the foils may be spirally wound around the shaft in order to create an axial pumping effect or in some cases (FIG. 4, rotor 40) the foils may comprise substantially radially extending pivots or plates in order to create an efficient mixing effect. A rotor especially for discharging gas may have an open center whereby the accumulation of the gas at the center of the rotor is facilitated and from which the gas is subsequently easily discharged either through an axial duct or through the openings in the back plate of the rotor and on the walls of the tower. Generally, it is not necessary for the discharge of gas to employ a device generating a vacuum, because the pressure caused by the pulp is sufficiently high for the discharge of gas from the center of the rotor. If the gas does not for some reason flow on its own from the gas bubble accumulated at the center of the rotor, it is, of course, possible to provide a source under pressure, e.g. a vacuum pump. It is advantageous for some embodiments that the rotational speed of the rotor is substantially the same as the rotational speed of the impeller, especially when the pump apparatus utilized is a centrifugal pump.

Figure 8A:
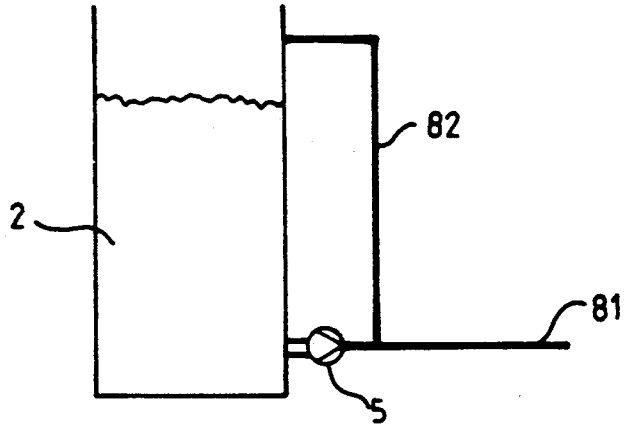
FIGS. 8*a*–8*c* are schematic illustrations of an eighth embodiment of the present invention.
Figure 8B:
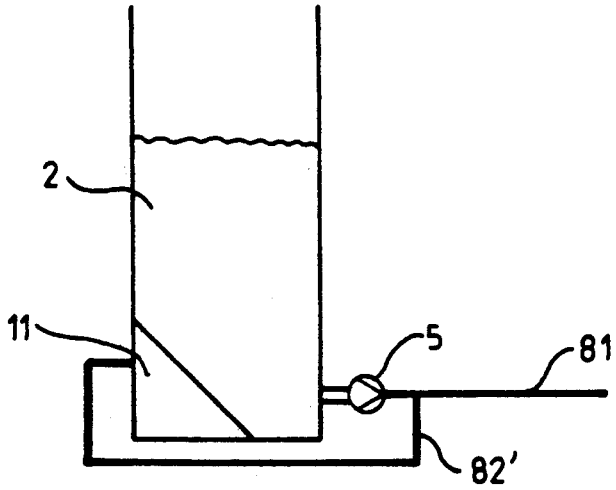
Figure 8C:
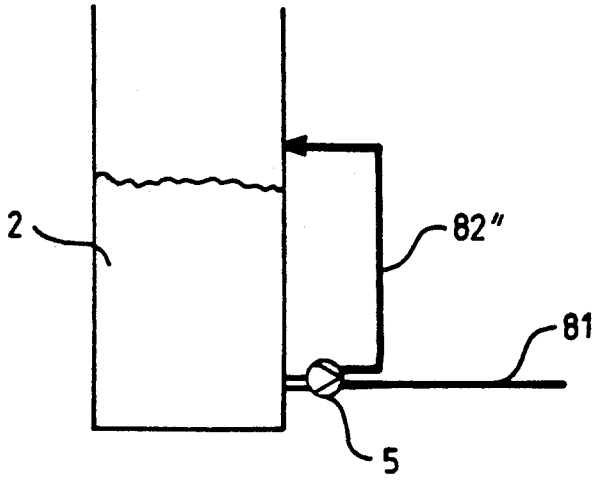

Yet another embodiment is illustrated in FIGS. 8*a*, 8*b* and 8*c*, in which a duct 82, 82', 82'', respectively is mounted to a pressure pipe 81 extending from the pump 5 (FIG. 8*a* and 8*b*) or being attached directly to the housing of the pump itself (FIG. 8*c*). Through duct 82, 82', 82'' the pulp which is homogenized by the pump, is directed back to the pulp space 2. Thereby a large amount of homogenized pulp is fed back and mixed with the non-homogenized pulp in the drop leg, mass tower or the like pulp space 2, thereby permitting the pumping of the pulp at a greater consistency than might be possible without such homogenization. It is thus preferred to feed the homogenized pulp back into the untreated pulp in the pulp space 2 via conduit 82 (FIG. 8*a*), whereby the homogenized pulp, which contains less air and is thus heavier, densifies the untreated pulp in the space. Another alternative (FIG. 8*b*) is to feed the pulp in a pressurized state, to break the standing pulp layer, for example, a standing pulp pillar or column in zone 11 at the bottom of the pulp space 2, which column causes the pulp plug to move only slowly toward the pump 5. When such a pulp column has been successfully broken up, the pulp plug flows downward in chamber 2 and no arching is generated in front of the pump. The described recirculation of pulp is advantageous for several reasons. First, by recirculating homogenized pulp it is possible to pump pulp at a consistency even several percents higher than without the recirculation. The apparent losses in efficiency due to the pulp circulation is however regained in that it is not necessary to dilute the pulp by the percentage. This is especially so when the pump pumping the pulp normally works on the rising part of its efficiency curve, in other words, when the pump is dimensioned for a significantly greater volume flow, whereby the power need of the pump increases very little compared with the increase of the volume flow of the pump. In some cases, it is possible to almost double the volume flow of the pump by an increase of about 10% in power. Recirculation of the pulp also increases the kinetic speed of the pulp plug in the pulp space relative to the amount of pulp in recirculation. In other words, when the homogenized pulp is returned to the pulp plug in the pulp space 2, the kinetic speed of the resulting plug is higher than what the speed would be without the pulp recirculation. Of course, the risk of the plug getting stuck on the wall of the space is also decreased.

As is apparent from the above description, a new method and apparatus have been developed by which it is possible to utilize the ability of the known pumps to pump high consistency pulp in situations where there is a problem of making the pulp flow toward the opening of the pump such as in mass towers, drop legs, suction chambers or the like pulp containing space. By utilizing the method and apparatus in accordance with the present invention, it has become possible to pump pulp having a consistency of about 8 to about 25% without excessive over dimensioning of the pump means. The energy consumption and ecologic problems of paper mills are significantly decreased because it is no longer necessary to dilute the pulp so as to decrease the consistency of the pulp to be pumped below 10%. In other words, the water consumption by the pulp and paper mills is significantly decreased and related activities such as pumping and pulp treatment performances are improved. Also, the method and apparatus of the present invention enable the mixing of processing chemicals, water and/or vapor into the pulp or the discharging of harmful gases from the pulp with the same apparatus with which the transfer of the pulp is achieved. Finally, as has been mentioned already above, it is possible to use the method and apparatus of the present invention, appropriately dimensioned, for deflaking of the fiber flocs or for high consistency pulpering.

Since these as well as further embodiments and modifications thereto are intended to be within the scope of the present invention, the above description should be construed as illustrative and not in a limiting sense, the scope of the invention being defined only by the following claims.

What is claimed is:

1. A method of facilitating the discharge of a high consistency cellulose fiber pulp having a consistency of from about 8% to about 25% from a high consistency pulp containing space, which space constitutes one of a mass tower and a drop leg and for treating said pulp in said space, said method comprising:

introducing said high consistency pulp including non-homogeneous pieces of pulp having pockets filled with air therebetween into said space in a substantially vertical direction;

withdrawing said pulp from said space in a direction transverse to said vertical direction of introduction by using a pumping means with a suction opening connected transversely to said space for pumping said pump from within said space, said withdrawing occurring without substantially changing the consistency of said pulp; and prior to withdrawing said pulp, homogenizing and densifying the high consistency pulp in a substantial portion of said space;

said homogenizing comprising, at a location remote from said pumping means breaking up the pulp pieces included in the pulp without disintegrating said fibers to substantially eliminate said air pockets and to generate an even downward flow of pulp in said space towards said suction inlet and to prevent arching of the pulp inn front of the pump suction opening.

2. The method in accordance with claim 1, additionally comprising the steps of withdrawing at least a part of the pulp from said space by said pumping; connecting the discharge side of the pump and the pulp containing space with a circulation flow passage; homogenizing and pressurizing at least part of the withdrawn pulp by said pumping action; and feeding said homogenized and pressurized pulp back to said pulp space through said circulation flow passage thereby homogenizing and densifying the pulp in said space.

3. The method in accordance with claim 2, wherein said pulp is withdrawn and recirculated directly from the housing of said pump.

4. The method in accordance with claim 2, wherein said pump has an inlet side in communication with said pulp containing space and a discharge side and a pressure conduit being connected to said discharge side of said pump; and wherein said pulp is withdrawn for recirculation from said pressure conduit.

5. The method in accordance with claim 2, wherein said pulp is recirculated and fed back to the bottom part of said pulp containing space.

6. The method of claim 2, wherein said pulp is recirculated and fed back to the upper part of said pulp containing space.

7. The method in accordance with claim 1, wherein the pulp comprises fiber flocs and pulp particles and wherein the pulp in the space is densified by removing gas therefrom; and at the same time breaking up the fiber flocs and pulp particles thereby facilitating the flow of pulp toward the pump.

8. The method in accordance with claim 1, wherein said pulp is treated by adding chemicals, water or vapor to said pulp in said space and wherein the step of homogenizing and densifying the pulp achieves, at the same time, the step of mixing chemicals, water or vapor that is introduced into the pulp space.

9. The method in accordance with claim 1, additionally comprising the step of fluidizing a portion of the pulp proximate the pump suction opening thereby causes the downward flow of the pulp in the space so that the pulp is flowing under its own weight toward the pump.

10. The method in accordance with claim 1, wherein the pulp comprises pulp planks and wherein the pulp in the space is homogenized and densified by withdrawing pulp from the space; pressuring the withdrawn pulp; and recirculating at least part of the pressurized pulp from the pump back to the space for reducing the amount of pulp planks in the pulp and for facilitating the pumping of the pulp.

11. The method according to claim 1, wherein said high consistency cellulose fiber pulp originates from one of a thickener or washer.

12. A method of facilitating the discharge of a high consistency cellulose fiber pulp having a consistency of from about 8% to about 25% from a high consistency pulp-containing space, which space constitutes one of a mass tower and a drop leg, and for treating said pulp in said space, said method comprising:

introducing a high consistency pulp including non-homogeneous pieces of pulp having pockets filled with air therebetween into said space in a substantially vertical direction;

withdrawing said pulp from said space in a direction transverse to said vertical direction of pulp introduction by using a pumping means with a suction opening connected transversely to said space for pumping said pulp from within said space, said suction opening being remotely spaced from any means for generating substantial fluidizing of the pulp, said withdrawing occurring without substantially changing the consistency of said pulp; and prior to withdrawing said pulp, homogenizing and densifying the high consistency pulp in the space;

said homogenizing comprising, at a location remote from said pumping means, breaking up the pulp planks includes in the pulp to facilitate the flow of pulp in said space towards said suction inlet and to prevent arching of pulp in front of the pump suction opening.

13. The method in accordance with claim 12, additionally comprising the steps of withdrawing at least a part of the pulp from said space by said pumping; connecting the discharge side of the pump and the pulp containing space with a circulation flow passage; homogenizing and pressurizing at least part of the withdrawn pulp by said pumping action; and feeding said homogenized and pressurized pulp back to said pulp space through said circulation flow passage thereby homogenizing and densifying the pulp in said space.

14. The method in accordance with claim 13, wherein said pulp is withdrawn and recirculated directly from the housing of said pump.

15. The method in accordance with claim 13, wherein said pump has an inlet side in communication with said pulp containing space and a discharge side; and a pressure conduit connected to said discharge side of said pump; and wherein said pulp withdrawn for recirculation from said pressure conduit.

16. The method in accordance with claim 13, wherein said pulp is recirculated and fed back to the bottom part of said pulp containing space.

17. The method of claim 13, wherein said pulp is recirculated and fed back to the upper part of said pulp containing space.

18. The method in accordance with claim 12, wherein the pulp comprises fiber flocs and pulp particles and wherein the pulp in the space is densified by removing gas therefrom; and at the same time breaking up the fiber flocs and pulp particles thereby facilitating the flow of pulp toward the pump.

19. The method in accordance with claim 12, wherein said pulp is treated in said space by adding chemicals, water or vapor and wherein the step of homogenizing and densifying the pulp achieves, at the same time, the step of mixing chemicals, water or vapor that is introduced into the pulp space.

20. The method in accordance with claim 12, wherein the pulp comprises pulp planks and wherein the pulp in the space is homogenized and densified by withdrawing pulp from the space; pressurizing the withdrawn pulp; and recirculating part of the pressurized pulp from the pump back to the space for reducing the amount of pulp planks in the pulp and for facilitating the pumping of the pulp.

21. A method of facilitating the discharge of a high consistency cellulose fiber pulp having a consistency of from 8% to about 25% from a high consistency pulp-containing space, which space constitutes one of a mass tower and a drop leg, said method comprising:

introducing into the space a high consistency pulp including non-homogeneous pieces of pulp; and withdrawing said pulp from said space without substantially changing the consistency of said pulp;

said withdrawing comprising pumping said pulp from within said space by a pump in such a manner as to homogenize the high consistency pulp that is so pumped;

pressurizing the withdrawn pulp; and further homogenizing and densifying said pulp in said space by recirculating at least a portion of the pressurized, withdrawn pulp back into said pulp-containing space, so as to enhance the efficiency of said discharge.

22. The method in accordance with claim 21, wherein said pulp is withdrawn and recirculated directly from a housing of said pump.

23. The method in accordance with claim 21, wherein said pump has an inlet side in communication with said pulp-containing space and a discharge side, a pressure conduit being connected to a discharge side of said pump; and wherein said pulp is withdrawn for recirculation from said pressure conduit.

24. The method in accordance with claim 21, wherein said pulp is recirculated and fed back to the bottom part of said pulp-containing space.

25. The method of claim 21, wherein said pulp is recirculated and fed back to the upper part of said pulp-containing space.

* * * * *

UNITED STATES PATENT AND TRADEMARK OFFICE

CERTIFICATE OF CORRECTION

PATENT NO. : 5,106,456

DATED : 4/21/92

INVENTOR(S) : Voitto et al

It is certified that error appears in the above-indentified patent and that said Letters Patent is hereby corrected as shown below:

On title page, item [75] should read as follows:

--[75] Inventors: Voitto Reponen, Karhula; Jukka Timperi; Reijo Vesala, both of Kotka; Vesa Vikman, Kymi, all of Finland--.

Signed and Sealed this

Twelfth Day of April, 1994

Bruce Lehman

*Attest:*

BRUCE LEHMAN

*Commissioner of Patents and Trademarks*

*Attesting Officer*